US011499396B2

(12) United States Patent
Boulet et al.

(10) Patent No.: US 11,499,396 B2
(45) Date of Patent: Nov. 15, 2022

(54) DOWNHOLE CLEANING TOOL

(71) Applicant: INNOVATIVE DRILLING SYSTEMS LIMITED, Aberdeen (GB)

(72) Inventors: Jean Gilbert Boulet, Paris (FR); Siegfried Johann Grabner, Klagenfurt (AT)

(73) Assignee: INNOVATIVE DRILLING SYSTEMS LIMITED, Aberdeen (GB)

( * ) Notice: Subject to any disclaimer, the term of this patent is extended or adjusted under 35 U.S.C. 154(b) by 248 days.

(21) Appl. No.: 16/647,686

(22) PCT Filed: Sep. 14, 2018

(86) PCT No.: PCT/GB2018/052639
§ 371 (c)(1),
(2) Date: Mar. 16, 2020

(87) PCT Pub. No.: WO2019/053464
PCT Pub. Date: Mar. 21, 2019

(65) Prior Publication Data

US 2020/0232304 A1 Jul. 23, 2020

(30) Foreign Application Priority Data

Sep. 14, 2017 (GB) ..... 1714789

(51) Int. Cl.
*E21B 17/22* (2006.01)
*E21B 37/10* (2006.01)
(Continued)

(52) U.S. Cl.
CPC ..... *E21B 37/10* (2013.01); *B08B 9/0321* (2013.01); *E21B 17/10* (2013.01); *E21B 17/22* (2013.01)

(58) Field of Classification Search
None
See application file for complete search history.

(56) References Cited

U.S. PATENT DOCUMENTS 4,744,420 A 5/1988 Patterson et al.
5,311,955 A 5/1994 Ganijew et al.
(Continued)

FOREIGN PATENT DOCUMENTS

AU 2016101412 A4 8/2016
CA 2552073 A1 1/2007
(Continued)

OTHER PUBLICATIONS

International Search Report from PCT/GB2018/052639 dated Jan. 10, 2019.

*Primary Examiner* — Giovanna Wright
(74) *Attorney, Agent, or Firm* — FisherBroyles, LLP

(57) ABSTRACT

A downhole borehole cleaning apparatus (10) for recirculating drill cuttings contained in a downhole borehole is provided and has a body (10) having an outer surface for contacting downhole fluid containing said drill cuttings, the downhole fluid comprising a certain pressure within the downhole borehole (16). The body (10) has a pair of bearing surfaces (30U; 30D) spaced apart along the longitudinal axis of the body (10), and the pair of bearing surfaces (30U; 30D) comprise substantially the same maximum outer diameter (d1) which is greater than the maximum outer diameter of the rest (14) of the body (10). Each of the pair of bearing surfaces (30U; 30D) comprises a substantially constant and un-interrupted diameter (d1) around its whole outer circumference for at least a portion of its longitudinal length; this forces all of the drilling fluid to pass around that maximum outer diameter. The outer surface of the body (10) further comprises a low pressure generation means (50) located in between the two longitudinally spaced apart bearing surfaces (30U; 30D) for generating a region of lower pressure in the downhole fluid within that region compared to the said certain pressure. A method of cleaning a downhole borehole is also described involving miming in a work string com-
(Continued)

prising a downhole borehole cleaning tool (10) into a borehole to be cleaned, and permitting or arranging for relative movement to occur between the downhole borehole cleaning tool (10) and fluid located in the annulus (15) in the borehole (16) whereby drill cuttings are recirculated.

25 Claims, 12 Drawing Sheets

(51) Int. Cl.
*B08B 9/032* (2006.01)
*E21B 17/10* (2006.01)

(56) References Cited

U.S. PATENT DOCUMENTS

| | | | |
|---|---|---|---|
| 6,732,821 | B2 | 5/2004 | Boulet |
| 7,182,160 | B2 | 2/2007 | Boulet |
| 2010/0326738 | A1 | 12/2010 | Boulet |

FOREIGN PATENT DOCUMENTS

| | | | |
|---|---|---|---|
| CA | 2743805 | A1 | 11/2012 |
| CN | 202970528 | U | 6/2013 |
| CN | 206418986 | U | 8/2017 |

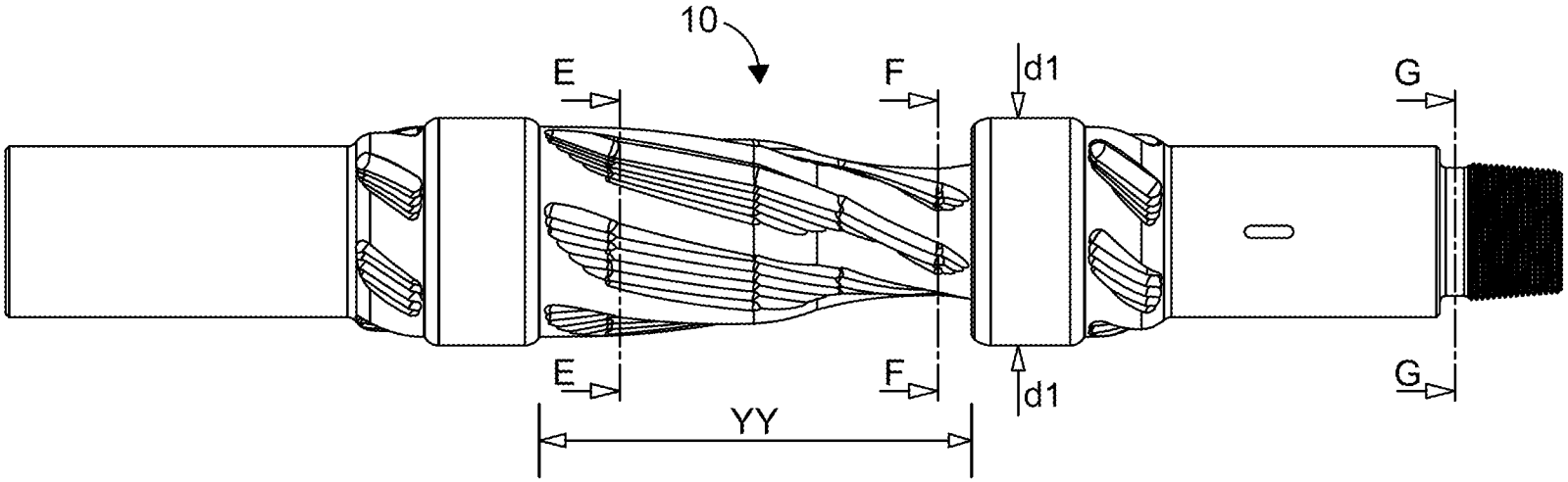
FIG. 5A
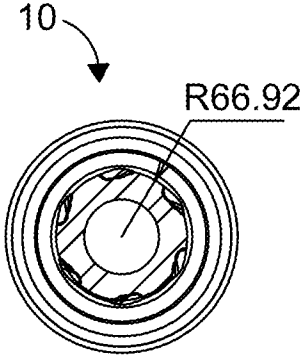
SECTION G-G
FIG. 5D
SECTION F-F
FIG. 5C
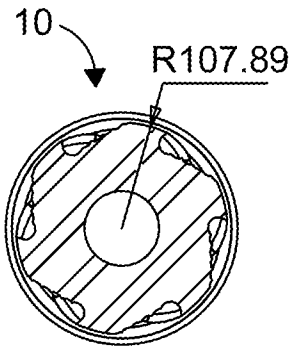
SECTION E-E
FIG. 5B

DOWNHOLE CLEANING TOOL

This application is the U.S. National Stage of International Application No. PCT/GB2018/052639, which was filed on Sep. 14, 2018. This application also claims the benefit of the filing date of GB patent application No. 1714789.3, which was filed on Sep. 14, 2017. The contents of both applications are hereby incorporated by reference.

BRIEF SUMMARY OF THE APPLICATION

The present invention relates to a downhole cleaning tool and more particularly but not exclusively relates to a downhole cleaning tool to be incorporated in a work string in order to promote movement and in particular recirculation of drill cuttings in a borehole.

BACKGROUND OF THE INVENTION

Conventionally, wellbore/borehole cleaning during hydrocarbon exploration drilling is a well known drilling process issue but is also quite complex in terms of causal analysis and techniques to control the same.

Hydrocarbon exploration drilling typically involves using a work string having a throughbore deployed from a rig at the surface. The work string comprises a drill bit at its very lowest end and which is rotated from surface by a string of drill pipe. Additional lengths of drill pipe are included into the work string at surface to allow the lower end of the work string to drill deeper into the subterranean earth. Fluid known as drilling mud is typically pumped down the throughbore of the work string in order to both lubricate and cool the drill bit but particularly also to flush or lift the rock cuttings known as drill cuttings away from the drill bit and back to the surface of the borehole in order that the work string and in particular the drill bit does not jam or get stuck in the borehole.

It can be considered that there are three main areas to be considered in terms of understanding and control of borehole cleaning of the drill cuttings:— i) the properties of the drilling mud;

ii) hydro-mechanical interactions within the annular space between the inner surface of the borehole wall and the outer surface of the work/drill string; and iii) design of the work/drill string including placement of various tools within the work/drill string and wiper trip practices.

The present invention relates to the second area indicated above to be considered—hydro-mechanical interactions.

When considering borehole cleaning complexity matters, a skilled person will understand that there are five main possible origins of drill cuttings:—

1) actual rate of penetration (ROP) of the axial drill bit cutting action;

2) side cutting and the dynamic behaviour of the drill bit;

3) borehole wall erosion or damage due to uncontrolled static and dynamic interactions with the drill string, leading to hole over-gauging and/or over-gouging and an associated increase of drill cuttings being produced;

4) borehole wall damage or instability due to hydraulic frictional forces applying to the inner borehole wall as fluid flows up the annulus between the inner surface of the borehole wall and the outer surface of the drill string; and 5) improper back reaming practices which can lead to pack off occurring to the inner surface of the borehole wall.

Given the number of factors and like the majority of drilling process phenomenons, hole cleaning performance conditions are typically best understood by those skilled in the art when a holistic approach is taken. The skilled person is also referred to "Determining Root Causes of Drilling Problems by Combining Cases and General Knowledge" technical paper published in 2009 by the authors SV Shokouhi, A Aamodt, P Skalle, F Sørmo, published at the 8th International Conference on Case-Based Reasoning, ICCBR 2009 Seattle, Wash., USA, Jul. 20-23, 2009 Proceedings, and which discusses such a holistic approach.

An important area of downhole borehole cleaning issues to be considered by those skilled in the art is to be able to minimise the settling of drill cuttings out of the drilling mud into the lower half of a horizontal or highly deviated borehole (i.e. a borehole having an angle of inclination to the horizontal of around 30 degrees or less); this is highly undesirable because the settled drill cuttings will start creating a bed which interferes with the work string and also reduces the cross-sectional area of the annulus between the outer surface of the work string and the inner surface of the borehole and this settlement of the drill cuttings into a bed due to gravity into the lower side of the borehole is highly undesirable.

It is therefore an object of the present invention to provide a downhole cleaning tool which can promote/encourage/move drill cuttings that have settled on the low side of a borehole and moreover promote/encourage/move said drill cuttings into the high side of the borehole within which the drilling mud is flowing fastest, and such promotion/encouragement/movement of the drill cuttings is referred to herein throughout as "re-circulation" of drill cuttings.

It is also a desirable object of the present invention to reduce or deal with localised drill cuttings accumulation which can otherwise cause high pack off risks. In that regard, the skilled person understands the importance of this aspect particularly because small cutting bed height can transform into sizeable or large cutting bed height under drill string motion and/or drilling mud flowing irregularities and skilled persons in the art understand that "dunes formation" can occur due to build up of said drill cuttings beds.

The skilled person also understands that hole cleaning is considered one of the key performance issues for hydrocarbon drilling processes, especially when considering that improper cleaning practices and improper component design selection can jeopardise drilling objectives especially in terms of non-productive time (NPT) and hole quality, and in this scope borehole cleaning should be considered as one of the major potential performance limiters.

It is therefore a desirable object of the present invention to reduce the height of drill cuttings bed, even a small height drill cuttings bed. It is a further aim of the present invention to achieve a high quality flowing lines pattern in the full borehole annulus, with less flowing disturbances, especially for optimised equivalent circulating density (ECD) control.

Numerous downhole cleaning tool components are available conventionally but many provide insufficient performance to cope with borehole cleaning complexity.

Some examples of conventional systems for promoting movement of drill cuttings downhole include the Hydroclean™ drill pipe of SMF International/Vallourac.

Another conventional/prior art tool is disclosed in U.S. Pat. No. 5,937,957 to George Swietlik for a "Cutting Bed Impeller".

Another conventional drill pipe provided with spiral blades is shown in U.S. Pat. No. 5,697,460. In addition, U.S. Pat. Nos. 2,894,725 and 3,102,600 show a junk basket for use in wellbores. It may also be useful for the skilled person to understand the effect of turbulent flow such as disclosed in "Analysis of the Turbulant Fluid Flow in an Axi-symmetric Sudden Expansion" published by Vikram Roy et al in the International Journal of Engineering Science and Technology Vol 2 (6), 2010, 1569-1574.

Much of the insufficient performance of conventional drilling components is due to improper flow rate of the drilling mud or insufficient rotational speed of the drill string and typical prior art tools suffer from the following dysfunctions and/or performance limitations:—

- inability to reduce drill cuttings bed height;
- strong fluid flowing lines pattern disturbances which are detrimental to efficiency of both drill cutting bed decay and ECD control;
- relatively low efficiency for driving or moving drill cuttings from the low side to the high side where drilling mud fluid flow velocity is greatest for efficient drill cuttings recirculation;
- there is a drastic decrease in cleaning efficiency at low RPM of the work or drill string (such as below 70-75 RPM);
- there is typically zero cleaning effect when there is no rotation of the work string (which is of course a big problem for running drill bits which are only rotated by a downhole motor); and
- low efficiency in any drill cuttings avalanching zone (where the borehole has a relatively steep inclination of around 45-60 degrees to the horizontal).

It is therefore an object of the present invention to at least partially solve any one, combination of some or all of the above disadvantages of the prior art.

STATEMENTS OF THE INVENTION

According to a first aspect of the present invention there is provided a downhole borehole cleaning apparatus for recirculating drill cuttings contained in a downhole borehole, the downhole borehole cleaning apparatus comprising:—

- a body comprising an outer surface for contacting downhole fluid containing said drill cuttings, wherein the downhole fluid comprises a certain pressure within the downhole borehole;
- wherein the body further comprises pair of bearing surfaces which are longitudinally spaced apart along the longitudinal axis of the body, and wherein the pair of bearing surfaces comprise substantially the same maximum outer diameter, and said maximum outer diameter of the bearings is greater than the maximum outer diameter of the rest of the body,
- wherein each of the pair of bearing surfaces comprises a substantially constant and un-interrupted diameter around its whole outer circumference for at least a portion of its longitudinal length; and
- wherein the outer surface of the body further comprises a low pressure generation means located in between the two longitudinally spaced apart bearing surfaces for generating a region of lower pressure in the downhole fluid within that region compared to the said certain pressure.

Preferably, the pair of axially spaced apart bearing surfaces are longitudinally spaced apart at a significant distance typically (when measured from their respective faces closest to one another) in the region of equal to or greater than the diameter of the bearing surfaces and more preferably are in the region of one to three times the outer diameter of the bearing surface and more preferably are between 1.75 and 2.25 times the outer diameter of the bearing surface and most preferably are between 1.8 and 2 times the outer diameter of the bearing surface. Preferably the pair of bearing surfaces comprise substantially the same maximum outer diameter, and typically, said maximum outer diameter of the bearings is greater than the maximum outer diameter of the rest of the body. Typically, the pair of bearings comprise an upper (or downstream) bearing and a lower (or upstream) bearing.

Preferably, the downhole borehole cleaning apparatus comprises a tool joint located at each longitudinal end thereof wherein each tool joint comprises connection means to permit said tool joint of the downhole borehole cleaning apparatus to be coupled to corresponding connection means on a tool joint of the next component of the tool string to which the downhole borehole cleaning apparatus is to be coupled. Preferably, the outer diameter of said bearings is preferably equal to or greater than the outer diameter of the tool joints of the downhole borehole cleaning apparatus.

Preferably, the low pressure generation means comprises one or more formations provided on the outer surface of the body.

Typically, the said one or more formations are adapted to generate said region of lower pressure in the downhole fluid due to relative movement occurring between a) the downhole fluid contacting said formations; and b) said formations.

Preferably said formations comprise a key direction angle surface portion of the outer surface of the body being arranged at an inclined angle to a longitudinal axis of the body. More preferably, the said key direction angle surface portion is arranged such that the enclosed angle between the bearing surface and the key direction angle surface portion comprises an angle of between:

- 15 degrees (and so can be considered to be a 15 degrees back angle) and 135 degrees.

Even more preferably the said enclosed angle between the bearing surface and the key direction angle surface portion comprises an angle of between:—

- 15 degrees (and so can be considered to be a 15 degrees back angle) and 90 degrees (and so can be considered to be parallel to the perpendicular axis with respect to the longitudinal axis of the body).

Even more preferably the said enclosed angle between the bearing surface and the key direction angle surface portion comprises an angle of between:—

- 35 degrees (and so can be considered to be a relatively tight 15 degrees back angle) and
- 55 degrees (and so can be considered to be a relatively wide 55 degrees back angle);

and so can be considered up to and preferably forming a recessed cavity chamber.

Most preferably the said enclosed angle between the bearing surface and the key direction angle surface portion comprises an angle of around 45 and preferably forms a recessed cavity chamber. Typically, the recessed cavity chamber comprises an axisymmetric cavity and typically the axisymmetric recessed cavity chamber of the low pressure generating means causes the cuttings to be re-circulated without the cleaning apparatus requiring rotation within the borehole.

Preferably, the downhole borehole cleaning apparatus further comprises a drill cuttings recirculation zone surface, which is preferably formed on the outer surface of the body and more preferably is also located on the outer surface of the body in between said pair of bearing surfaces. Most preferably, the low pressure generations means is located upstream of the drill cuttings recirculation zone surface.

Typically, the drill cuttings recirculation zone surface is located adjacent the low pressure generations means.

Typically, the drill cuttings recirculation zone surface comprises a tapering outer surface along its longitudinal length and more preferably, the drill cuttings recirculation zone surface tapers outwardly from:—

- a relatively small outer diameter at its upstream end, preferably adjacent to the downstream end of the said formation of the low pressure generation means; to
- a relatively large outer diameter at its downstream end, preferably adjacent to the downstream bearing.

Preferably the drill cuttings recirculation zone surface further comprises one or more grooves or scoops formed therein and which are adapted to permit drill cuttings to be caught within said groove(s) and further adapted to permit the drill cuttings to flow along the groove(s) in an upstream to downstream direction (i.e. in an upwards direction towards the surface of the downhole borehole). Typically, said groove(s) comprise a smaller outer diameter than the adjacent rest of the drill cuttings recirculation zone surface at that circumferential location on the longitudinal axis of the body.

Preferably, the outer diameter of the bearing surfaces are not full gauge and more preferably are less than full gauge, such that an annulus is provided between the outer surface of the bearing surfaces and the inner surface of the borehole within which the downhole fluid (and cuttings) can flow.

Preferably, each of outer surface bearing surfaces comprises a substantially constant and un-interrupted diameter around its whole outer circumference for at least a portion of and more preferably the whole of its longitudinal length such that all of the downhole fluid (and drill cuttings) must flow past and around the outer substantially smooth surface of the bearings. Preferably, there are no blades and therefore no fluid flow channels through the bearing surfaces and therefore all of the downhole fluid located in the annulus of the borehole is typically forced to flow around the whole of the outer diameter of the pair of bearing surfaces and will therefore be subjected to the higher flow velocity that will result.

According to a second aspect of the present invention there is provided a method of cleaning a downhole borehole comprising the steps of:—

- running in a work string comprising a downhole borehole cleaning tool in accordance with the first aspect into a borehole to be cleaned, and permitting or arranging for relative movement to occur between the downhole borehole cleaning tool and fluid located in the borehole whereby drill cuttings are recirculated.

In the description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments of the present invention are shown in the drawings, and herein will be described in detail, with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string but is typically open holed at the location requiring to be cleaned. Reference to up or down will be made for purposes of description with the terms:—

- "above", "up", "upward" or "upper" meaning away from the bottom of the wellbore along the longitudinal axis of a work string toward the surface;
- "downstream" meaning fluid that is flowing in a direction away from the bottom of the wellbore along the longitudinal axis of a work string toward the surface, with reference to a point location at which the flow of fluid has already flowed past that point location and is heading towards the surface up the borehole;
- "below", "down", "downward" and "lower" meaning toward the bottom of the wellbore along the longitudinal axis of the work string and away from the surface and deeper into the well; and
- "upstream" meaning fluid that is flowing in a direction away from the bottom of the wellbore along the longitudinal axis of a work string toward the surface, with reference to a point location at which the flow of fluid is flowing towards the point location and has therefore yet to flow past that point location;

whether the well being referred to is a conventional vertical well or a deviated well and therefore includes the typical situation where a rig is above a wellhead, and the well extends down from the wellhead into the formation but also horizontal wells where the formation may not necessarily be below the wellhead. Similarly, 'work string' refers to any tubular arrangement for conveying fluids and/or tools from a surface into a wellbore. In the present invention, drill string is the preferred work string.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature and not as restrictive.

Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited, and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements or any other components described herein including (without limitations) components of the apparatus/downhole cleaning tool are understood to include plural forms thereof and vice versa.

BRIEF DESCRIPTION OF THE DRAWINGS

Embodiments of the present invention will now be described, with reference to the accompanying drawings, in which:—

FIG. 1(*b*) is a sectional view of the cleaning sub across cross-section P-P of FIG. 1(*a*) and is viewed from the upstream towards downstream direction (viewed from right to left of FIG. 1(*a*)) such that the downstream bearing is being viewed;

FIG. 1(*c*) is a perspective view of the cleaning sub of FIG. 1(*a*) (albeit the ends of the cleaning sub are omitted from FIG. 1(*c*)) wherein representative fluid flow lines and drill cutting movement lines are also shown to aid understanding of the skilled person;

FIG. 1(*d*) is a cross-sectional side view of the cleaning sub of FIG. 1(*c*) showing how the various diameters thereof are arranged;

FIG. 2(*b*) is a sectional view across cross-section X-X of FIG. 2(*a*), looking in the direction from the upstream end to the downstream end such that the downstream bearing of FIG. 2(*a*) can be viewed in FIG. 2(*b*);

FIG. 4(*b*) is a perspective view of the cleaning sub of FIG. 4(*a*) from the downstream end;

FIG. 4(*c*) is a perspective view of the cleaning sub of FIG. 4(*a*) from the upstream end;

FIG. 4(*d*) is an end view of the cleaning sub of FIG. 4(*a*) from the downstream end;

FIG. 4(*e*) is an end view of the cleaning sub of FIG. 4(*a*) from the upstream end;

FIG. 5(*a*) is a side view of the cleaning sub of FIG. 4(*a*);

FIG. 5(*b*) is a cross-sectional side view across section E-E of the cleaning sub of FIG. 5(*a*) showing how the various diameters thereof are arranged;

FIG. 5(*c*) is a cross-sectional side view across section F-F of the cleaning sub of FIG. 5(*a*) showing how the various diameters thereof are arranged;

FIG. 5(*d*) is a cross-sectional side view across section G-G of the cleaning sub of FIG. 5(*a*) showing how the various diameters thereof are arranged;

FIG. 6(*a*) is a cross-sectional side view across section A-A of the cleaning sub of FIG. 6 showing how the various diameters thereof are arranged;

FIG. 6(*b*) is a cross-sectional side view across section B-B of the cleaning sub of FIG. 6 showing how the various diameters thereof are arranged;

FIG. 6(*c*) is a cross-sectional side view across section C-C of the cleaning sub of FIG. 6 showing how the various diameters thereof are arranged;

FIG. 6(*d*) is a cross-sectional side view across section D-D of the cleaning sub of FIG. 6 showing how the various diameters thereof are arranged;

FIG. 6(*e*) is a cross-sectional side view of the cleaning sub of FIG. 6;

FIG. 6(*f*) is a cross-sectional detailed side view of a part of the cleaning sub of FIG. 6(*e*) showing in particular a close up view of the outer bearing surface of the downstream bearing;

FIG. 6(*g*) is a cross-sectional detailed side view of the cleaning sub of FIG. 6(*e*) showing in particular a close up view of the enclosed angle KDA between the upstream outer bearing surface and the key direction angle surface portion;

FIG. 6(*h*) is a different cross-sectional detailed side view (different to that of FIG. 6(*g*) of the cleaning sub of FIG. 6(*e*) showing in particular a close up view of the most preferred enclosed angle KDA between the upstream outer bearing surface and the Key Direction Angle surface portion being in the region of 45 degrees;

FIG. 6(*i*) is a cross-sectional detailed side view of an alternative embodiment of a cleaning sub in accordance with the present invention but only shows in particular a close up view of an alternative enclosed angle KDAA between the upstream outer bearing surface and the key direction angle surface portion being in the region of 135 degrees.

DETAILED DESCRIPTION OF PREFERRED EMBODIMENTS

Figure 1A:
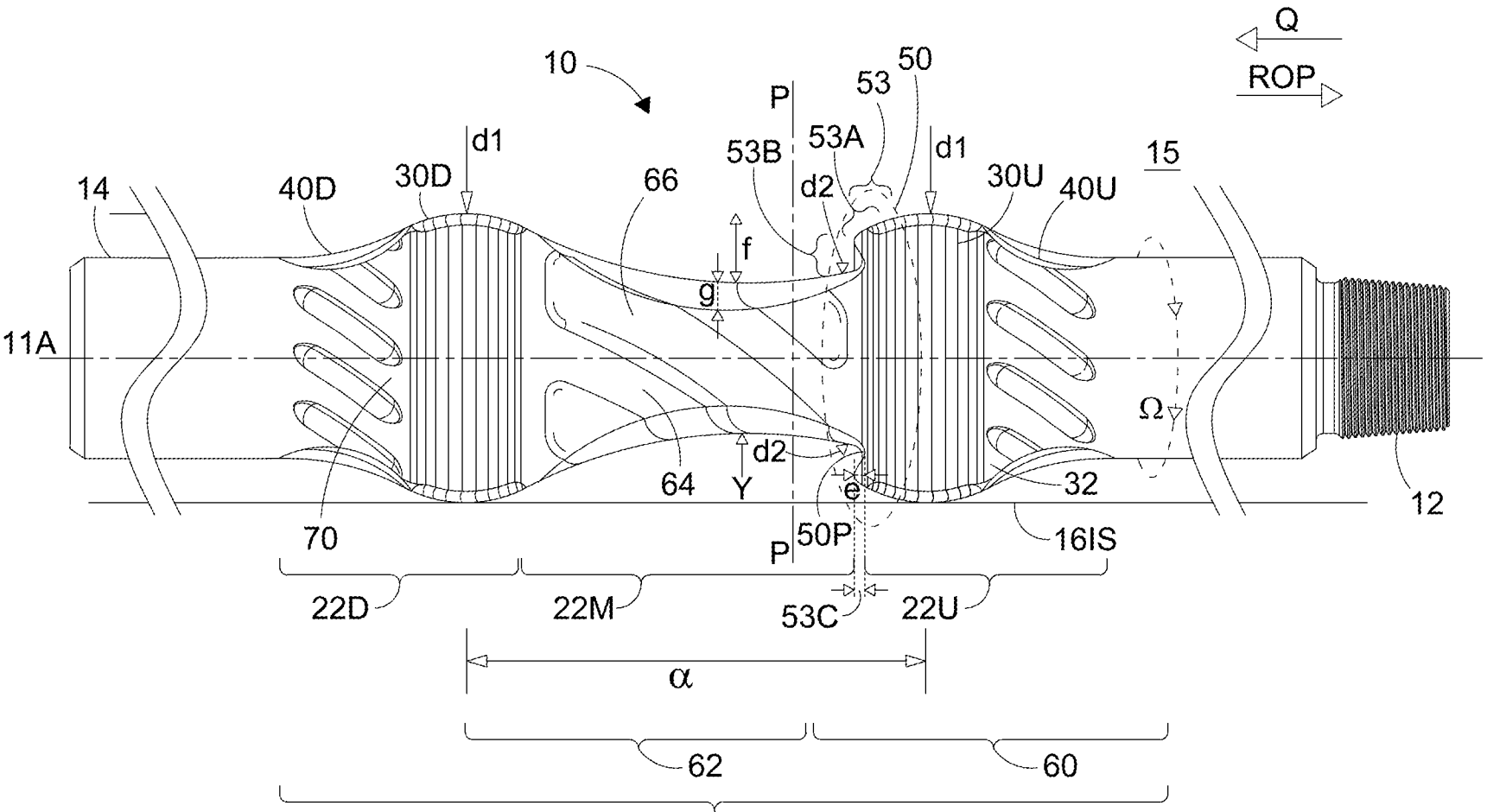
FIG. 1(*a*) is a side view of a first embodiment of a downhole borehole cleaning apparatus in accordance with the present invention, where the left hand end of the apparatus as viewed in FIG. 1(*a*) is the downstream end or in use vertically upper most end and the right hand side end is the upstream end or the in use vertically lower most end, and where the cleaning apparatus is in the form of a cleaning sub having one upset as will be described in detail below.
Figure 1B:
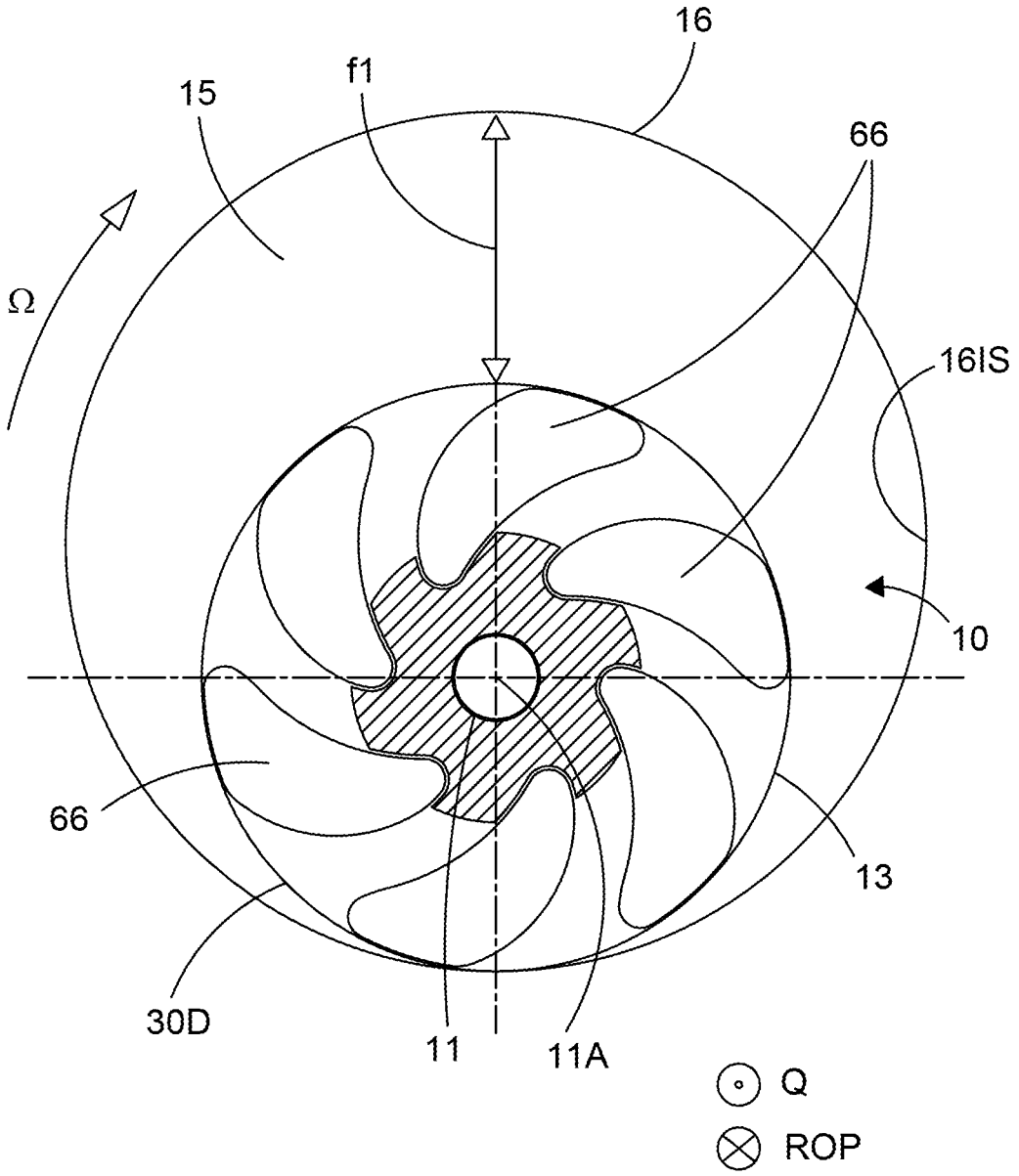
Figure 1C:
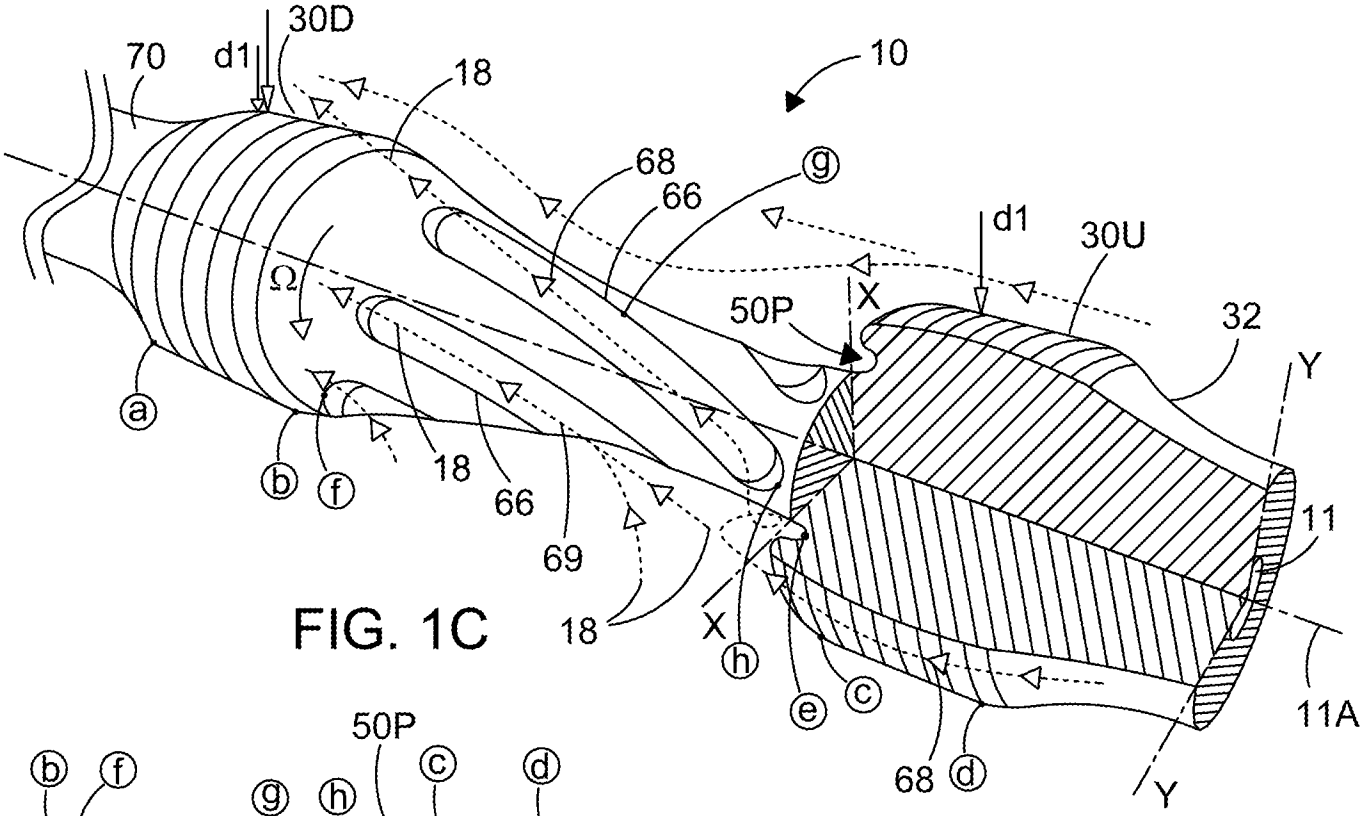
Figure 1D:
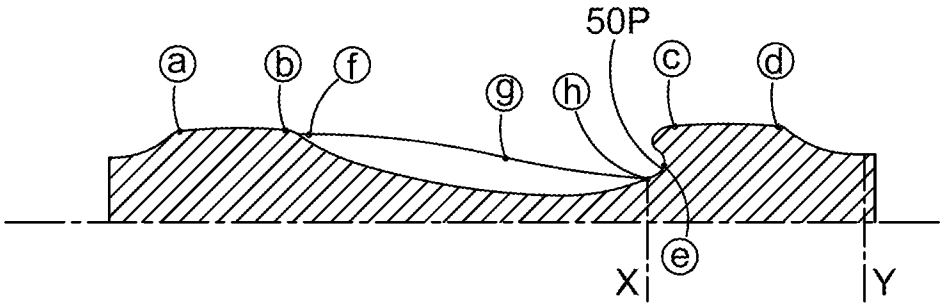

FIG. 1(*a*) shows a first embodiment of a downhole borehole cleaning apparatus 10 in the form of a cleaning sub 10. The cleaning sub 10 is typically in the region of 6-18 feet in length and is provided with suitable couplings such as standard API certified pin and box screw threaded connections (12, 14) at either end to enable the cleaning sub 10 to be included in a work string (not shown) such as a drill string (not shown) for insertion in to a downhole borehole 16 which is being drilled and which may have drill cuttings 18 which are desired to be recirculated, see drill cuttings bed 18 in FIG. 2(*b*).

The most relevant or important part of the invention of the cleaning sub 10 is the upset portion 20, where the upset portion comprises three main parts, these being:— i. the downstream zone 22D;

ii. the middle zone 22M; and iii. the upstream zone 22U.

The cleaning sub 10 comprises its pin connection 12 at its in-use vertically lower most end such that the pin connection 12 (the right hand end as shown in FIG. 1(*a*)) is, in-use, positioned closest to the drill bit (not shown) and the box connection 14 is, in use, positioned closest to the surface of the borehole such that the pin connection 12 can be considered as the, in-use, most upstream end because it is closest to the source of the drilling mud in the annulus 15 located between the outer surface 13 of the cleaning sub 10 and the inner surface 16 of the borehole 16 that has just been drilled by the drill bit located at the leading (lower most) end of the drill string, where the drilling mud has been pumped down through the throughbore 11 of the drill string and out into the annulus 15 via the drill bit.

The cleaning sub 10 will therefore be advanced into the borehole in the direction of arrow ROP (rate of penetration) as shown in FIG. 1(*a*) and the direction of the drilling mud flowing in the annulus 15 toward the surface of the borehole is indicated by arrow Q as shown in the direction from right to left in FIG. 1(*a*). Accordingly, the direction of flow of the drilling mud Q is in the direction from upstream to downstream (from right to left) as shown in FIG. 1(*a*).

The upset 20 comprises a pair of longitudinally spaced apart bearings 30, where one of the bearings 30U is the upstream bearing 30U and is provided in the upstream zone 22U, and the other bearing 30D is the downstream bearing 30D and is provided in the downstream zone 22D. The upstream bearing 30U and the downstream bearing 30D are, as measured from their longitudinal mid-points (shown by the arrow D1), spaced apart along the longitudinal axis 11A of the cleaning sub 10 by distance alpha (a). Moreover, the distance YY between the respective inner faces of the bearings 30U, 30D closest to one another is preferably around 1.9 times the outer diameter dl of the bearings 30U, 30D, but could be between equal and up to 3 times thereto. The middle zone 22M is located immediately between the downstream most end of the upstream bearing 30U and the upstream most end of the downstream bearing 30D.

The outer most diameter D1 of the bearings 30U, 30D is preferably provided with a relatively hard facing such as hard banding and is adapted to be relatively hard wearing in order to protect the bearings 30U, 30D and therefore prevent wear occurring to the bearings 30U, 30D in order to increase the life of the bearings 30D, 30U and therefore the cleaning sub 10. However, the hard facing of the bearings 30U, 30D will also not cut into the mud cake of the inner surface 16 of the borehole 16 and therefore won't damage the mud cake. Furthermore, the outer diameter D1 of the pair of bearings 30U, 30D is preferably arranged to be the greatest diameter or at least equal to the greatest diameter of any other component included in the drill string, such that the outer surface of the bearings 30U, 30L is the most likely outer surface of the whole of the work string, with the exception of the drill bit (not shown), to make contact with the inner surface 161S of the borehole 16. Accordingly, the outer diameter D1 of the bearings 30U, 30D are not full gauge and are less than full gauge, such that an annulus 15 is provided between the outer surface of the bearings 30U, 30D and the inner surface of the borehole 16 within which the downhole fluid (and cuttings) can flow.

Moreover, each of outer surfaces of the pair of bearings 30U, 30D comprises a substantially constant and un-interrupted diameter D1 around its whole outer circumference for at least a portion of and more preferably (as shown in the drawings) the whole of its longitudinal length such that all of the downhole fluid (and drill cuttings) must flow past and around the outer substantially smooth surface of the bearings 30D, 30U. In other words, there are no blades and therefore no fluid flow channels through the bearings 30U, 30D and therefore all of the downhole fluid located in the annulus of the borehole is forced to flow around the whole of the outer diameter of the pair of bearing surfaces 30U, 30D and will therefore be subjected to the higher flow velocity that will result.

As shown in FIG. 1(*a*), the cleaning sub 10 is adapted to be included in a work string (not shown) which is rotated from surface in the rotational direction omega (Ω) as shown in FIG. 1(*a*) (rotated at the surface in the clockwise direction).

The upstream zone 22U comprises (from upstream most end to downstream most end) an outwardly tapering outer surface 32 and which tapers outwardly from a narrowest end at its upstream most end to its greatest diameter at its downstream most end adjacent to the upstream bearing 30U, where the outer diameter of the outwardly tapering outer surface 32 at its junction with the upstream bearing 30U matches the maximum outer diameter D1 of the upstream bearing 30U. Furthermore, a number of part helically arranged upstream cleaning grooves 40U are formed within the outwardly tapering outer surface, where the upstream cleaning grooves 40U will help to promote movement of any drill cuttings flowing in the direction Q. The upstream zone 22U then comprises, toward its downstream end, the upstream bearing 30U. The upstream zone 22U then leads, in the direction Q, into the middle zone 22M. The skilled person will understand that the upstream bearing zone 22U will act as a flushing shield for the drill cuttings and which allows the drill cuttings to be separated from the cuttings 18 but prevents them (i.e. acts as a shield) from landing again in the bed 18 after only a short length of travel (which would of course be undesirable were it to happen).

Figure 6:
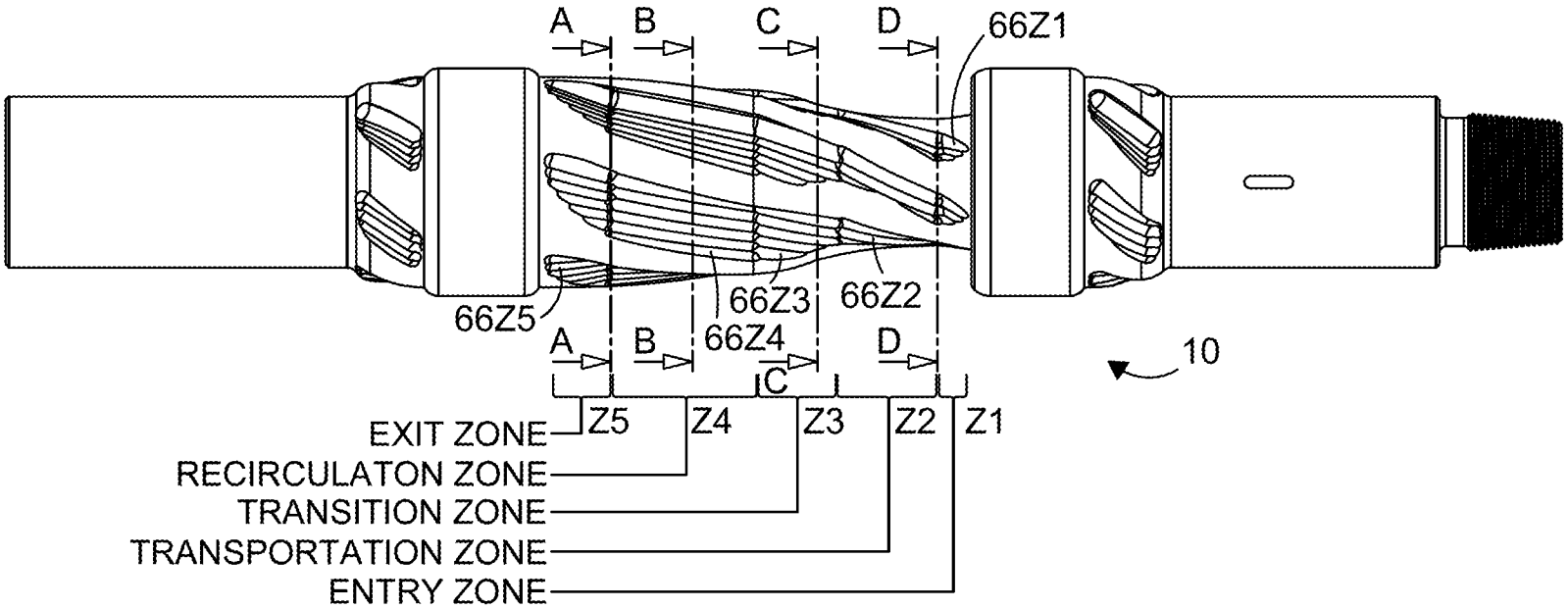
FIG. 6 is a further side view of the cleaning sub of FIG. 4(*a*)
Figures 6A, 6B, 6C, 6D:
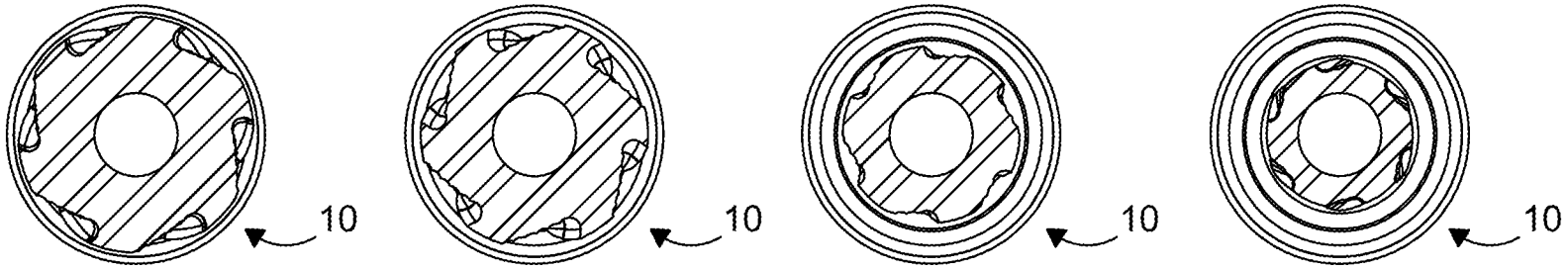
FIG. 6(J) is a cross-sectional detailed side view of another alternative embodiment of a cleaning sub in accordance with the present invention but only shows in particular a close up view of an enclosed angle KDAZ between the upstream outer bearing surface and the key direction angle surface portion being in the region of 15 degrees.
Figures 6E, 6F, 6G:
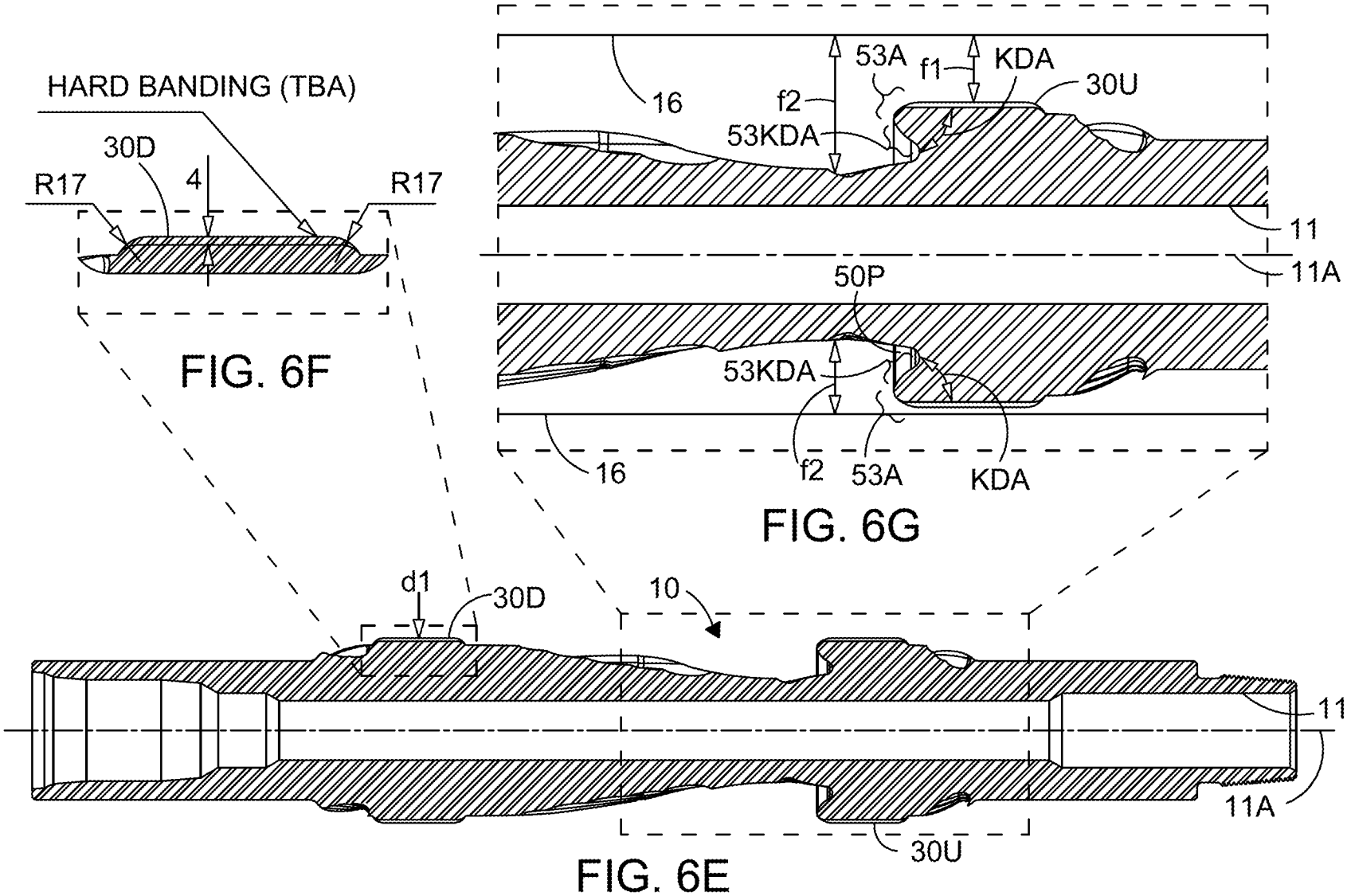
Figure 6H:
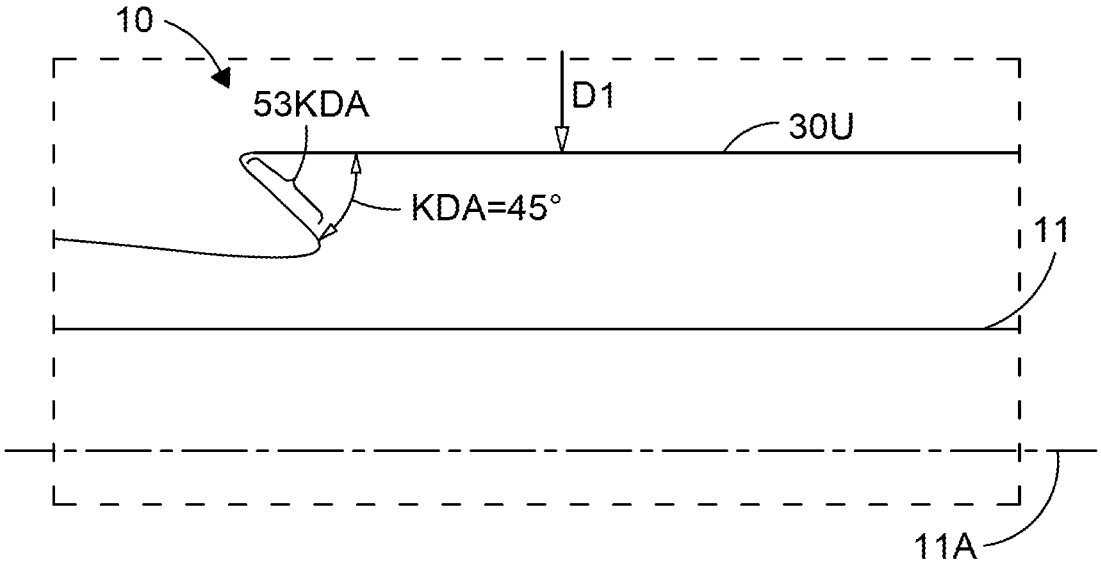
Figure 6I:
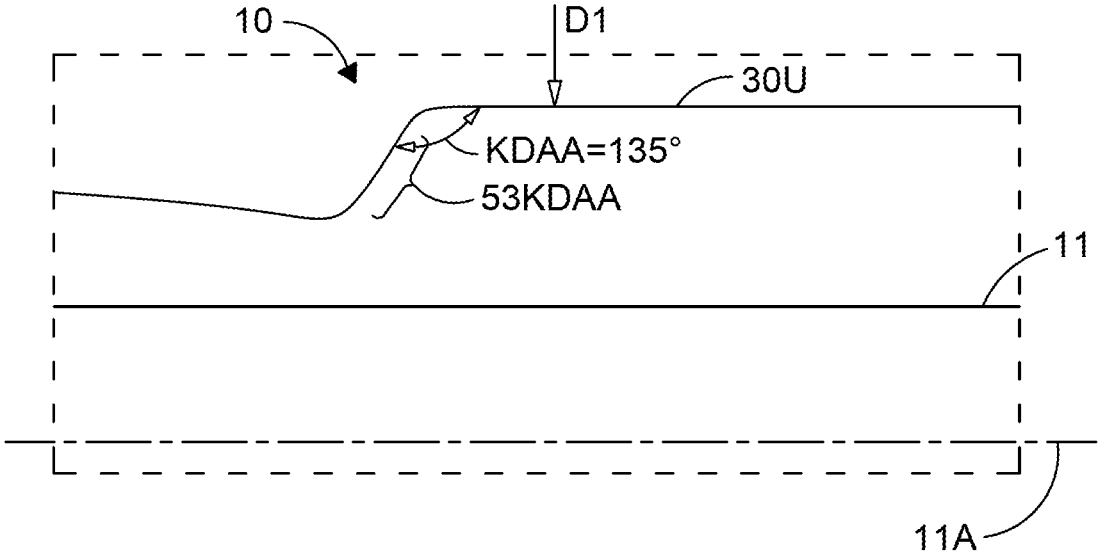

The middle zone 22M comprises at its upstream most end (the right hand end in FIG. 1(*a*)) a low pressure generation means 50 in the form of a formation 50 provided on its outer surface 53 and more particularly comprises a recessed cavity/low pressure creation chamber 50 which is provided by a portion of the outer surface 53 of the cleaning sub 10 where the portion of the outer surface 53 rapidly narrows or tapers in its outer diameter between the maximum outer diameter D1 of the upstream bearing 30U to the much narrower outer diameter D2, where the angle of the transition portion of the outer surface 53 curves very sharply in a first (substantially curvilinear) portion 53A from being parallel with the longitudinal axis 11A at its upstream most end to being perpendicular to the longitudinal axis 11A of the cleaning sub 10 at its downstream most end. The said first portion 53A of the outer surface 53 then leads into a second (substantially rectilinear) portion 53B which importantly comprises a key direction angle surface 53KDA (see FIGS. 6(*g*) and 6(*h*)) and can be considered to be inclined at a negative angle (with respect to the direction of arrow Q of FIG. 1(*a*)), in that the second portion 53B continues to curve from being perpendicular to the longitudinal axis 11A of the cleaning sub 10 to be inclined at a negative angle in the region of 45 degrees to the perpendicular (with respect to the long axis 11A of the cleaning sub 10). In other words, the second portion 53B has a substantial or majority of its length at an angle of around negative 45 degrees to the perpendicular in an upstream direction (ROP direction) with respect to the radially outwards pointing direction and so can be considered around a 45 degrees back angle. In yet other words, the enclosed angle KDA between the substantially parallel (with respect to the longitudinal axis 11A) outer surface of the bearing 30U and the key direction angle surface area 53KDA is around 45 degrees. The said second portion 53B of the outer surface 53 then leads into a third portion 53C which sharply curves back around through the perpendicular (such that it heads back in the downstream direction) and has the majority of its outer surface lying at a positive angle of between 60 and 30 degrees to the perpendicular (with respect to the longitudinal axis 11A of the cleaning sub 10) in a downstream direction (the Q direction) with reference to the radially outwards pointing direction. Thus the second portion 53B and the third portions combined comprise a serpentine cross section. Crucially, with the angle of the outer surface of the said portion 53 ranging between at least plus 45 degrees to the perpendicular and negative 75 degrees to the perpendicular, the outer diameter of the recessed cavity/low pressure creation chamber 50 changes very rapidly in a relatively short longitudinal length of the cleaning sub 10 and indeed due to the negative back angle, a low pressure creation pocket 50P is formed. The low pressure creation chamber 50 and especially the low pressure creation pocket 50P is therefore comprised of a combination of rectilinear (particularly the direction angle surface portion 53KDA) and curvilinear portions (particularly the first substantially curvilinear portion 53A), and it is this geometry that provides the low pressure generation means of the low pressure creation chamber.

In use of the cleaning sub 10, drilling mud flowing in the annulus 15 in the direction Q at a particular velocity will, due to Bernoulli's principle (which the skilled person will understand only applies in zones of continuous variation of flowing passage area and does not apply in turbulent fluid flow zones), increase in velocity as it flows past the outwardly tapering outer surface 32 and past the outer surface of the upstream bearing 30U (i.e. through narrowed flowing passage area f1 past the outer surface of the upstream bearing 30U) and this increase in velocity of the drilling mud will, due to Bernoulli's principle, result in a decrease in the pressure of that drilling mud as it transitions through the upstream zone 22U. The low pressure drilling mud will then enter the recessed cavity/low pressure creation chamber 50 and in particular the low pressure creation pocket 50P but due to the sudden expansion of volume and thus fluid flow from upstream zone 22A to middle zone 22M i.e. through the much wider flowing passage area f2 at the narrowest part of the middle zone 22M and the narrowest part of the whole cleaning sub 10, the drilling mud experiences turbulent flow in the recessed cavity/low pressure chamber 50 and thus the skilled person will understand that Bernoulli's principle will not apply to the drilling mud in the recessed cavity/low pressure chamber 50. Thus the low pressure creation chamber 50 will attract drill cuttings 18 coming from both upstream and within the drill cuttings bed 18 on the low side of the borehole 16 and so will cause the latter to be stirred and thus recirculated within the recessed cavity/low pressure creation chamber 50 and in particular in the low pressure creation pocket 50P. The skilled person will therefore understand that Bernoulli's principle will apply to the drilling mud flowing through upstream zone 22U and downstream zone 22D and after separation of the fluid stream (out of turbulent flow) downstream of the low pressure creation pocket 50P and the skilled person will further understand that the low pressure creation pocket 50P represents a fluid flow discontinuity zone where Bernoulli's principle does not apply.

It is important for the skilled person to realise that the recessed cavity/low pressure creation chamber 50 will cause recirculation of the drill cuttings whether or not the cleaning sub 10 is being rotated (in rotational direction omega) or not. In other words, recirculation of drill cuttings 18 can occur without rotation of the cleaning sub 10, as long as there is relatively longitudinal movement occurring between the drilling mud (such as in the direction of arrow Q) and the outer surface of the upstream zone 22U and in particular the recessed cavity/low pressure creation chamber 50.

It should also be noted that the recessed cavity/low pressure creation chamber 50 could be modified to not actually require a negative back angle in the second portion 53B and instead the second portion 53B could continue to be a positive angle of around 45 degrees because that would likely still provide some recirculation of drill cuttings in the drill cuttings bed 18 but it is likely that it would not be as effective as the negative back angle of second portion 53B as shown in FIG. 1(*a*).

The upstream zone 22U plus the part of the low pressure creation chamber 50 which is not specifically part of the upstream zone 22U can together be considered a cutting attraction zone 60. The cutting attraction zone 60 then, moving toward the downstream end of the cleaning sub 10 leads into a reflection and recirculation zone 62 which comprises the rest of the middle zone 22M and the downstream zone 22D.

The middle zone 22M downstream of the recessed cavity/low pressure creation chamber 50 comprises an outwardly gradually tapering outer surface 64 such that the outer diameter of the outwardly gradually tapering outer surface 64 tapers outwardly from a smallest outer diameter at point Y (where diameter Y plus distance f equals D1) to its largest diameter which equals D1 at the point at which the outer surface 64 meets the downstream bearing 30D. It is important to note that a number of scooping and pumping grooves 66 have been formed in a helical manner around the outer surface 64 of the middle zone 22M along the longitudinal axis 11A thereof and in use, and as can be seen in FIGS. 1(*c*) and 2(*a*) in particular, drill cuttings 18 suspended in and carried by drilling mud will flow along flow path 68 (and other flow paths) from the upstream end of the downhole cleaning tool 10, around the upstream zone and be turbulently displaced or moved and therefore recirculated within the low pressure creation chamber 50 and in particular the low pressure creation pocket 50P and then likely be attracted and/or scooped into the grooves 66 and then pumped along them until the drill cuttings 18 exit the grooves 66 at their downstream end. In addition, drill cuttings that are already collected in the drill cuttings bed 18B (as shown in FIG. 2(*a*)) are likely to be recirculated in the low pressure creation chamber 50 and scooped into the grooves 66.

It should be noted that the letter reference numerals A, B, C, D, E, F, G, H, X and Y as shown in FIG. 1(*c*) are replicated in the cross-sectional side view of FIG. 1(*d*) to show how the various different diameters of the cleaning sub 10 are arranged. However, the letters used as reference numerals in FIGS. 1(*c*) and (*d*) are exclusive to those Figures.

Figure 2A:
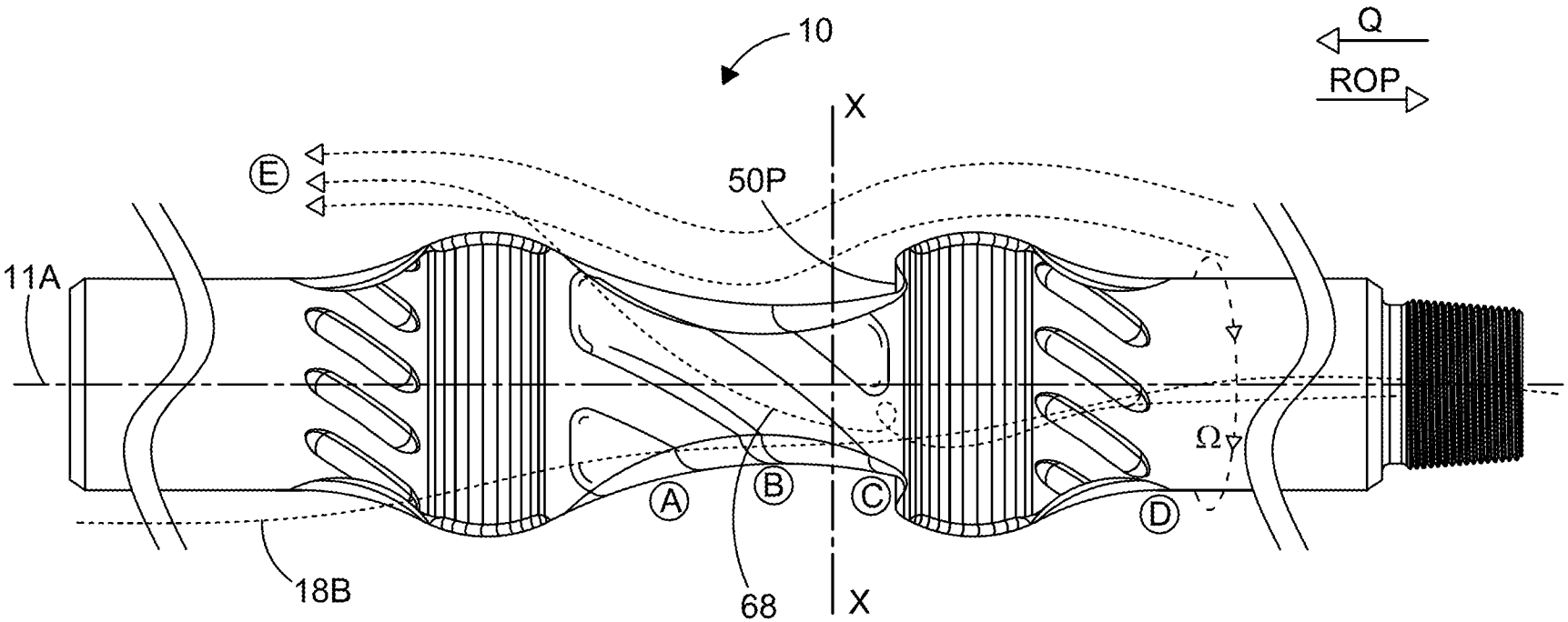
FIG. 2(*a*) is a side view of the cleaning sub of FIG. 1(*a*) but with representative fluid flow lines and drill cutting movement lines also shown to aid understanding of the skilled person.
Figure 2B:
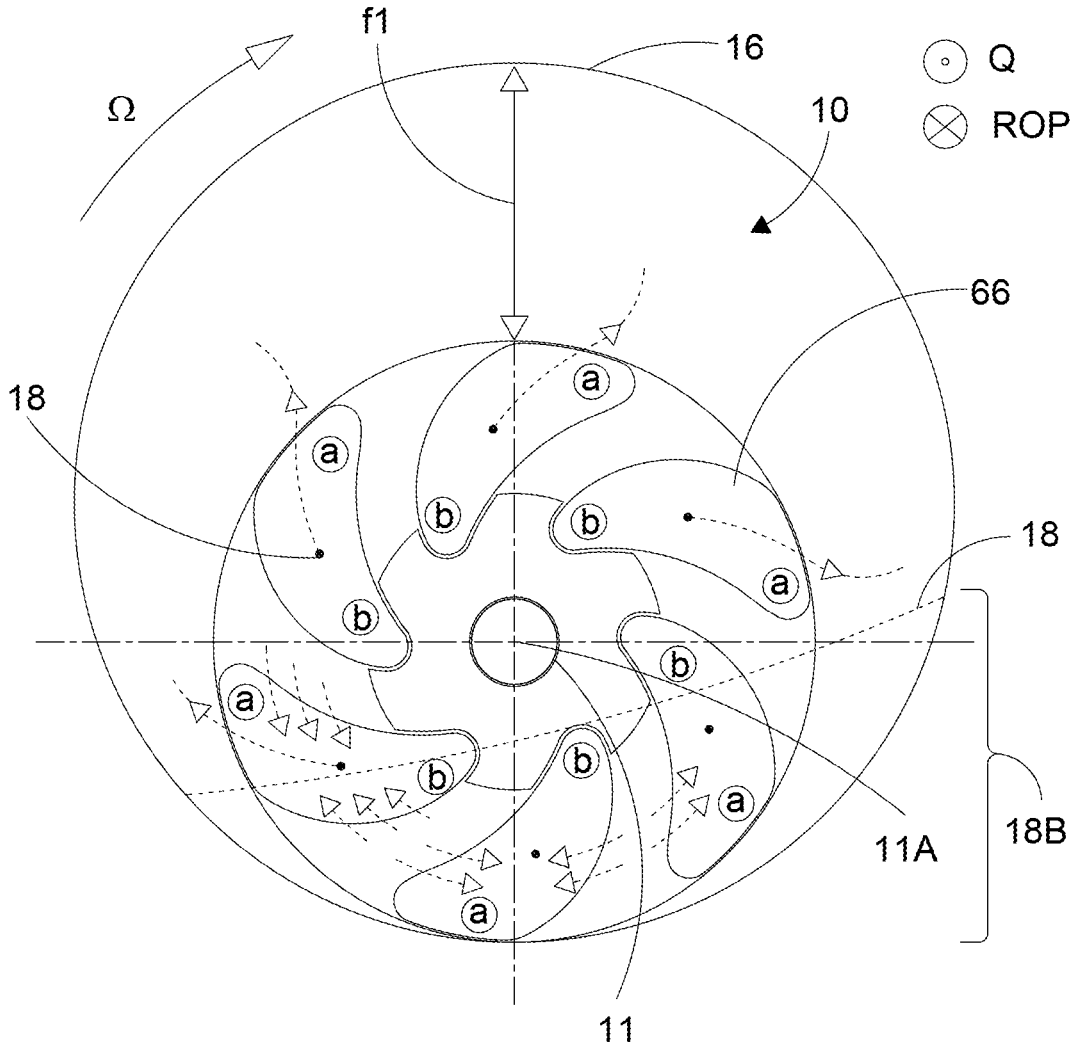

The skilled person should note and understand that the pressure of the drilling mud in area B as shown in FIG. 2 is lower than the pressure of the drilling mud in area C of FIG. 2 due directly to Bernoulli's principle and thus that pressure differential (or pressure gradient effect) creates an effect of drill cuttings attraction from low pressure creation pocket 50P to area B and onward to area A as shown in FIG. 2 and further onward to downstream zone 22*d* where the annulus velocity of drilling mud is at a maximum velocity (again due to Bernoulli's principle). Accordingly, the low pressure drill cuttings recirculation pocket 50P will generate a continuous attraction towards itself of drill cuttings from upstream zone 22U. Moreover, the drill cuttings will then be pushed or forced into grooves 66 by the aforementioned pressure gradient effect thus further assisting in recirculating the drill cuttings and moving them from the bed 18B into the high side of the borehole and thus into the high velocity annulus.

Immediately at the downstream end of the middle zone 22M, the middle zone 22M meets the upstream end of the downstream bearing 30D and downstream of the downstream bearing 30D is located an inwardly tapering outer surface 70 which tapers inwardly from the maximum diameter D1 of the bearing 30D inwardly to the outer diameter of the box connection 14 tool joint diameter. The inwardly tapering outer surface 70 is at a relatively shallow taper of typically 30 degrees or less and therefore tapers at a similar angle (albeit in an opposite direction) to the angle of the outwardly tapering outer surface 32. An arrangement of part helically arranged and longitudinally extending downstream cleaning grooves 40D are provided in the inwardly tapering outer surface 70 and are particularly suited for recirculating drill cuttings 18 when the cleaning tool 10 (and the associated work string) is being pulled out of the hole and therefore the downstream cleaning grooves 40D will act to back ream drill cuttings 18 located in any drill cuttings beds 18B that are further downstream in the borehole than the cleaning tool 10.

In the specific example disclosed herein, the outer diameter dl of the upstream and downstream bearings is 9.5 inches and the outer diameter of the tool joints (i.e. the pin 112 and box 114) are 7 inches (where the rest of the drill pipe string is typically 5.5 inch OD drill pipe) and given that the drill bit (not shown) will have drilled the borehole to have an inner diameter of approx. 12.25 inches, that results in f1 to be in the region of a 2.75 inch annular gap (f1 being the distance between the outer surface of the bearings 30D, 30U and the inner surface of the upper half of the borehole 16). Furthermore, due to the geometry of the low pressure generating means 50, the maximum cross sectional area of the flowing passage f2 (i.e. that created by the distance at the narrowest part of the middle zone 22M and the inner surface of the borehole 16) in between the two bearings 30U, 30D and in particular that experienced by the drilling fluid and cuttings in the borehole after they have passed the upstream bearing 30U is a very sudden increase in the flowing passage cross-sectional area (i.e. f2−f2=very sudden increase) in the region of 25% to 120% increase in the passage flowing passage cross-sectional area from f1 to f2.

The skilled person will understand that the above most preferred diameters in inches will scale up or down as appropriate to suit other diameter boreholes/other sizes of cleaning subs 10.

Figure 3:
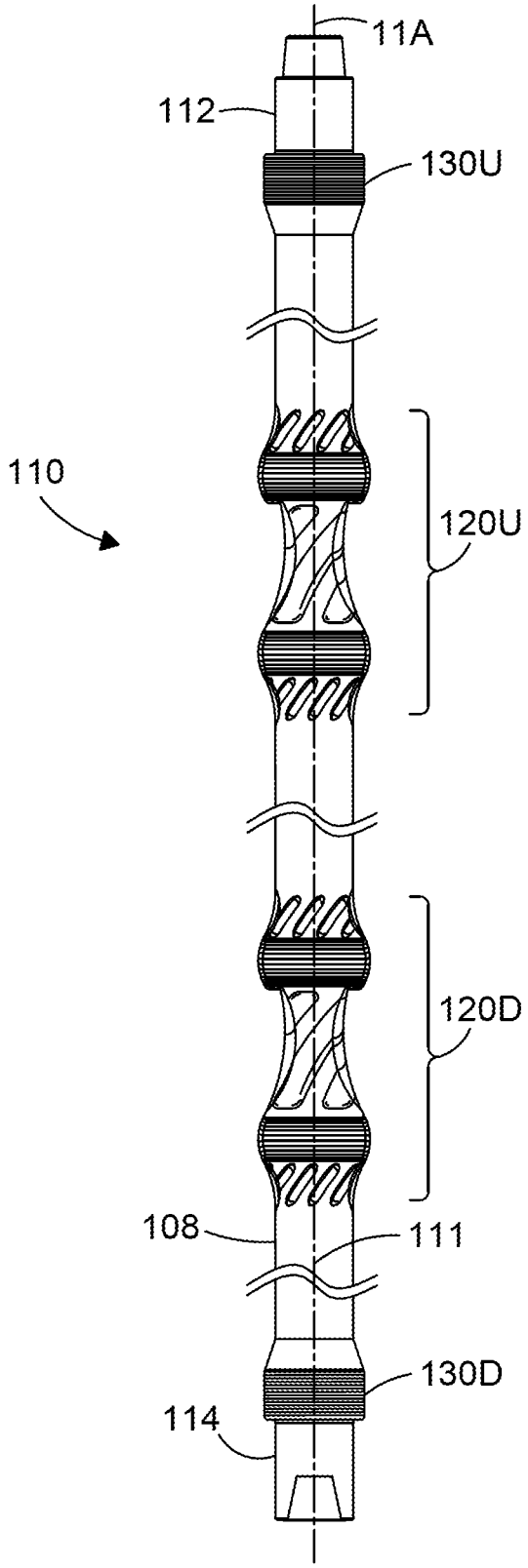
FIG. 3 is a second embodiment of a downhole borehole cleaning apparatus in accordance with the present invention and particularly in the form of a length of drill pipe having two upsets which are each substantially the same as the upset shown in the first embodiment of the downhole borehole cleaning apparatus in the form of the cleaning sub of FIG. 1(*a*)
Figure 4A:
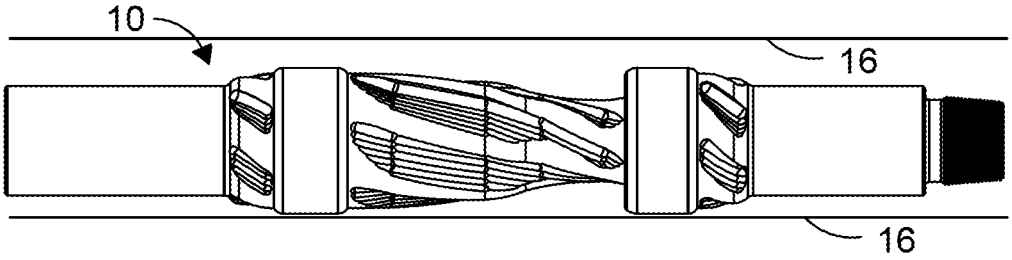
FIG. 4(*a*) is a side view of a third embodiment of a downhole borehole cleaning apparatus in accordance with the present invention, where the left hand end of the apparatus as viewed in FIG. 4(*a*) is the downstream end or in use vertically upper most end and the right hand side end is the upstream end or the in use vertically lower most end, and where the cleaning apparatus is in the form of a cleaning sub having one upset and as will be described in detail below, is very similar to the first embodiment of FIG. 1(*a*)
Figure 4D:
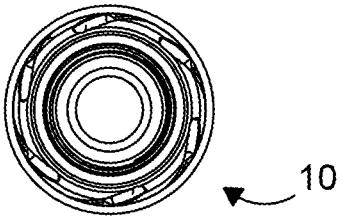
Figure 4E:
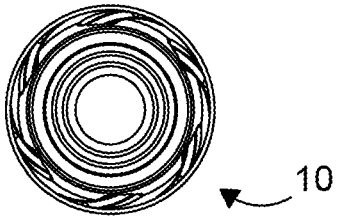
Figure 4B:
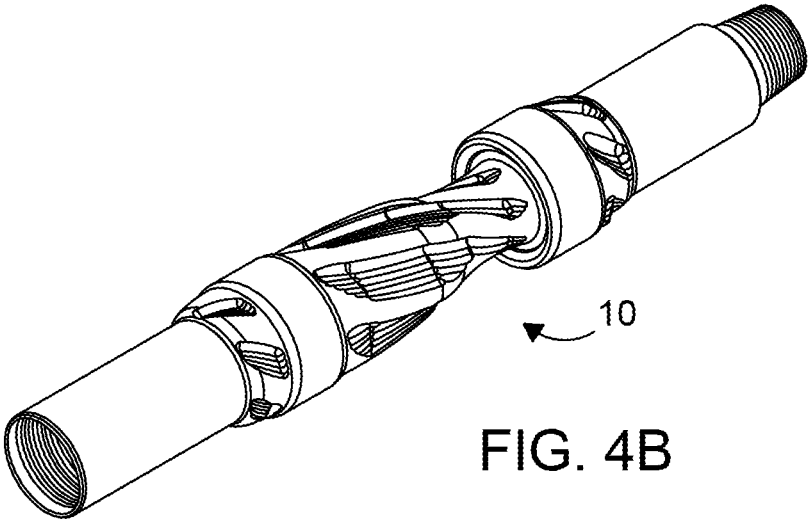
Figure 4C:
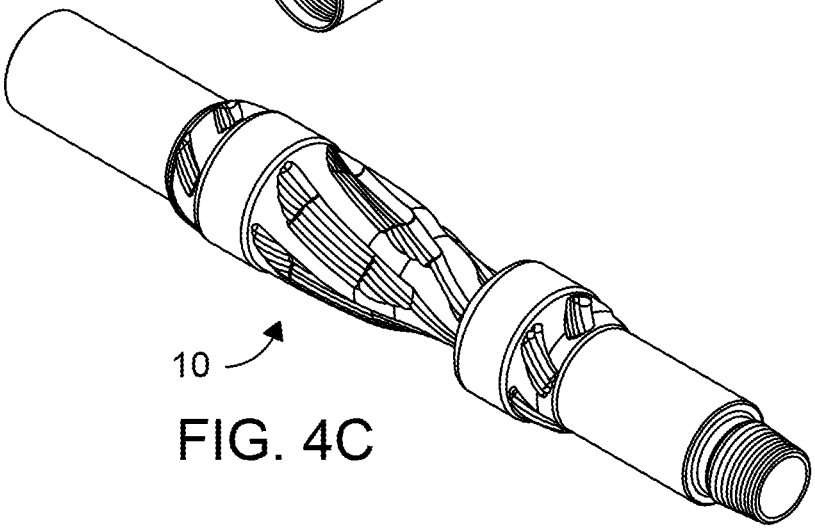

FIG. 3 shows an alternative/second embodiment of a downhole borehole cleaning apparatus 110 in the form of a length of modified drill pipe 108. The drill pipe 108 has been modified by comprising two upsets 120D, 120U provided spaced apart along its longitudinal length, where each of the upsets 120D, 120U is similar in structure and function to the upset 20 described above in relation to the first embodiment of the cleaning sub 10. Accordingly, all similar features between the embodiments 10 and 110 are indicated with the same reference number but with an additional 100 added to the reference number used in the embodiment 110 shown in FIG. 3.

FIGS. 4(*a*) to 6(*h*) show the most preferred embodiment of the cleaning sub 10 being located on the bottom of a borehole 16 such that the annulus 15 is located above the cleaning sub 10. The cleaning sub 10 of FIG. 4(*a*) is very similar to that of FIG. 1(*a*) except that the middle zone 22M of the cleaning sub of FIG. 4(*a*) comprises:— i. Entry Zone Z1—the drill cuttings will enter Z1 and then move to
ii. Transportation Zone Z2—the drill cuttings will then move to
iii. Transition Zone Z3—the drill cuttings will then move to
iv. Recirculation Zone Z4—the drill cuttings will then move to
v. Exit Zone Z5

Where each of zones 1 to 5 comprise separately arranged but conjoining respective grooves 66Z1; 66Z2; 66Z3; 66Z4; 66Z5 which have their own tapering angles in order to provide specialist assistance to the cuttings to motivate movement of the cuttings depending upon which Zone the cuttings are in.

In addition, as well as the upstream upset 120U and the downstream upset 120D being provided in the drill pipe 110, each of the pin 112 and box 114 connectors each comprise a respective upstream 130U and downstream 130D bearing.

Accordingly, FIG. 3 and the drill pipe 110 shown therein comprises three main performance aspects compared to a conventional drill pipe length:— i. drill cutting cleaning efficiency due to continued use of mechanical and hydro-mechanical energies (even at zero RPM) compared to conventional downhole cleaning tools which only use RPM rotational energy and therefore the drill pipe can be used with downhole motor drilling (unlike conventional downhole cleaning tools);
ii. significant static loading control (ie reducing the friction between the bearings including 130D and 130U, and the two bearings contained within each upset 120D, 120U) and the borehole;
iii. significant dynamic loading control (ie reducing lateral vibrations);
iv. low pressure chamber 50 and low pressure creation pocket 50P will continuously feed drill cuttings to the cleaning grooves 66 while offering an optimised arrangement against the occurrence of cuttings avalanching occurring in the borehole when the borehole comprises a trajectory angle of between 30° and 60° to the vertical.

By providing the two upsets 120U, 120D as shown FIG. 3 (and the skilled person will realise that more upsets such as three upsets could be provided), a relevant length of drill pipe 108 will have significant drill cutting cleaning performance compared to a conventional drill pipe.

The modified drill pipe 108 and the cleaning sub 10 are respectively each unitary components having a body 10 formed from one piece of metal (and are preferably solid forgings thereof) such that the body 10 is an integral body 10 which provides the significant additional advantage over conventional cleaning tools in that they comprise no moving parts (relative to the rest of modified drill pipe 108 and the cleaning sub 10) and therefore there is likely to be significantly greater longevity of tools 108; 10 compared to conventional cleaning tools with moving parts. In addition, the low pressure zone created by the sudden and drastic increase in axisymetrical flowing passage or area of the low pressure generating means 50 and in particular the axisymmetric recessed cavity chamber 50*p* or axisymmetric low pressure creation pocket 50*p* of the low pressure generating means 50 provides continuous cuttings attraction (prior to controlled recirculation) and thus causes the cuttings to be re-circulated without the cleaning sub tool 10/drill pipe 108 requiring rotation within the borehole. Accordingly, the cleaning sub tool 10/drill pipe 108 can recirculate the cuttings within the borehole 16 both whilst rotating and also whilst stationary which is a very significant advantage compared to most other prior art cleaning/recirculating tools (not shown).

Figure 6J:
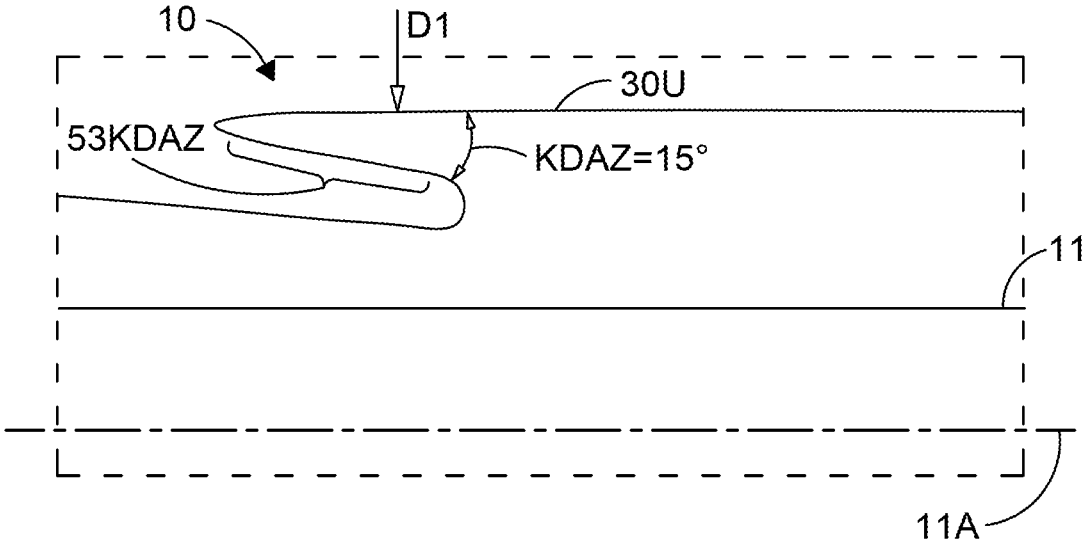

Modifications and improvements may be incorporated to the embodiments hereinbefore described without departing from the scope of the invention. For example, the enclosed angle KDA between the bearing surface 30U and the key direction angle surface portion 53KDA can be changed (from the said preferred enclosed angle of 45 degrees of e.g. FIG. 6(*h*)) in other embodiments of downhole cleaning tools in accordance with the present invention such that the enclosed angle KDAA is 135 degrees (as shown in the alternative embodiment shown in FIG. 6(*i*)) or the enclosed angle KDAZ is 15 degrees (as shown in the alternative embodiment shown in FIG. 6(J)) or any suitable angle therebetween. However the enclosed angle KDA being equal to or around 45 degrees is preferred because that provides a good compromise between providing a good volume sized low pressure chamber 50 and in particular a good volume sized low pressure creation pocket 50*p* and also not so large that the cuttings will end up being retained in the low pressure creation pocket 50*p*.

The invention claimed is:

1. A downhole borehole cleaning apparatus for recirculating drill cuttings contained in a downhole borehole, the downhole borehole cleaning apparatus comprising:

a body comprising an outer surface for contacting downhole fluid containing said drill cuttings, wherein the downhole fluid comprises a certain pressure within the downhole borehole;

wherein the body further comprises pair of bearing surfaces which are longitudinally spaced apart along the longitudinal axis of the body, and wherein the pair of bearing surfaces comprise substantially the same maximum outer diameter, and said maximum outer diameter of the bearings is greater than the maximum outer diameter of the rest of the body, wherein each of the pair of bearing surfaces comprises a substantially constant and un-interrupted diameter around a whole outer circumference of the bearing surface for at least a portion of a longitudinal length of the bearing surface; and wherein the outer surface of the body further comprises a low pressure generation means located in between the two longitudinally spaced apart bearing surfaces for generating a region of lower pressure in the downhole fluid within that region compared to the said certain pressure.

2. The downhole borehole cleaning apparatus of claim 1, wherein the outer diameter of the pair of bearing surfaces is less than the full gauge of the borehole into which the downhole borehole cleaning apparatus is to be run, such that an annulus is provided between the outer surface of the body including the outer surface of the pair of bearing surfaces and the inner surface of the borehole.

3. The downhole borehole cleaning apparatus of claim 2, wherein the outer diameter of the pair of bearing surfaces is substantially smooth such that downhole fluid located in the annulus of the borehole is forced to flow around the whole of the outer diameter of the pair of bearing surfaces.

4. The downhole borehole cleaning apparatus of claim 2, further comprising a tool joint located at each longitudinal end thereof wherein each tool joint comprises connection means to permit said tool joint of the downhole borehole cleaning apparatus to be coupled to corresponding connection means on a tool joint of the next component of the tool string to which the downhole borehole cleaning apparatus is to be coupled and wherein the outer diameter of said bearings is greater than the outer diameter of the tool joints of the downhole borehole cleaning apparatus.

5. The downhole borehole cleaning apparatus of claim 2, wherein, the said low pressure generation means are located on the outer surface of the body in between said pair of bearing surfaces and wherein the low pressure generation means comprises one or more formations provided on the outer surface of the body and wherein the said one or more formations are adapted to generate said region of lower pressure in the downhole fluid due to relative movement occurring between a) the downhole fluid contacting said one or more formations; and b) said one or more formations.

6. The downhole borehole cleaning apparatus of claim 5, wherein said one or more formations comprise a key direction angle surface portion of the outer surface of the body being arranged at an angle to a longitudinal axis of the body.

7. The downhole borehole cleaning apparatus of claim 6, wherein the said key direction angle surface portion is arranged such that the enclosed angle between the bearing surface and the key direction angle surface portion comprises an angle of between:

15 degrees and 135 degrees.

8. The downhole borehole cleaning apparatus of claim 6, wherein the said enclosed angle between the bearing surface and the key direction angle surface portion comprises an angle of between:—15 degrees and 90 degrees or between 35 degrees and 55 degrees.

9. The downhole borehole cleaning apparatus of claim 6, wherein the said enclosed angle between the bearing surface and the key direction angle surface portion comprises an angle of around 45 degrees.

10. The downhole borehole cleaning apparatus of claim 1, further comprising a drill cuttings recirculation zone surface formed on the outer surface of the body.

11. The downhole borehole cleaning apparatus of claim 10, wherein the drill cuttings recirculation zone surface is located on the outer surface of the body in between said pair of bearing surfaces.

12. The downhole borehole cleaning apparatus of claim 10, wherein the low pressure generations means is located upstream of the drill cuttings recirculation zone surface.

13. The downhole borehole cleaning apparatus of claim 12, wherein the drill cuttings recirculation zone surface is located adjacent the low pressure generations means.

14. The downhole borehole cleaning apparatus of claim 11, wherein the drill cuttings recirculation zone surface comprises a tapering outer surface along a longitudinal length of the drill cuttings recirculation zone surface.

15. The downhole borehole cleaning apparatus of claim 14, wherein the drill cuttings recirculation zone surface tapers outwardly from:— a relatively small outer diameter at upstream end, adjacent to the downstream end of the said formation of the low pressure generation means; to a relatively large outer diameter at a downstream end, adjacent to the downstream bearing.

16. The downhole borehole cleaning apparatus of claim 10, wherein the drill cuttings recirculation zone surface further comprises one or more grooves or scoops formed therein and which are adapted to permit drill cuttings to be caught within said groove(s) and further adapted to permit the drill cuttings to flow along the groove(s) in an upstream to downstream direction.

17. The downhole borehole cleaning apparatus of claim 16, wherein said groove(s) comprise a smaller outer diameter than the adjacent rest of the drill cuttings recirculation zone surface at that circumferential location on the longitudinal axis of the body.

18. The downhole borehole cleaning apparatus of claim 1, wherein said apparatus is a unitary component, devoid of separate moving parts.

19. A length of drill pipe comprising a tool joint located at each longitudinal end thereof wherein each tool joint comprises connection means to permit said tool joint to be coupled to corresponding connection means on a tool joint of another length of drill pipe; and at least two downhole cleaning apparatus according to claim 1 located in series spaced apart along the longitudinal length of the drill pipe;

wherein each downhole cleaning apparatus further comprises a pair of axially spaced apart bearing surfaces which are longitudinally spaced apart along the longitudinal axis of the body.

20. A length of drill pipe according to claim 19, wherein the outer diameter of the bearings of the downhole cleaning apparatus bearings is greater than the outer diameter of the tool joints of the said length of drill pipe.

21. A length of drill pipe according to claim 19, wherein said drill pipe is a unitary component, devoid of separate moving parts.

22. A method of cleaning a downhole borehole comprising the steps of:— running in a work string comprising at least one length of drill pipe in accordance with claim 19 into a borehole to be cleaned; and permitting or arranging for relative movement to occur between at least one of the said downhole borehole cleaning apparatus provided on the said length of drill pipe and fluid located in the borehole, whereby drill cuttings are recirculated.

23. A method of cleaning a downhole borehole comprising the steps of:— running in a work string comprising a downhole borehole cleaning tool in accordance with claim 1 into a borehole to be cleaned; and permitting or arranging for relative movement to occur between the downhole borehole cleaning apparatus and fluid located in the borehole, whereby drill cuttings are recirculated.

24. A method according to claim 23 wherein the outer diameter of the pair of bearing surfaces is less than the full gauge of the downhole borehole, such that an annulus is provided between the outer surface of the body the inner surface of the borehole.

25. The method of claim 24, wherein the outer diameter of the pair of bearing surfaces is substantially smooth such that downhole fluid located in the annulus of the borehole is forced to flow around the whole outer diameter of the pair of bearing surfaces.

* * * * *